US006862022B2

(12) United States Patent
Slupe

(10) Patent No.: US 6,862,022 B2
(45) Date of Patent: Mar. 1, 2005

(54) METHOD AND SYSTEM FOR AUTOMATICALLY SELECTING A VERTICAL REFRESH RATE FOR A VIDEO DISPLAY MONITOR

(75) Inventor: James P. Slupe, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 217 days.

(21) Appl. No.: 09/910,645

(22) Filed: Jul. 20, 2001

(65) Prior Publication Data

US 2003/0016215 A1 Jan. 23, 2003

(51) Int. Cl.[7] ..... G09G 5/00
(52) U.S. Cl. ..... 345/207; 348/602
(58) Field of Search ..... 345/102, 207, 345/211, 213, 204, 212, 690, 699; 348/602, 227.1, 366

(56) References Cited

U.S. PATENT DOCUMENTS 4,952,917 A * 8/1990 Yabuuchi ..... 345/690
5,325,195 A 6/1994 Ellis et al.
5,396,593 A * 3/1995 Mori et al. ..... 345/501
5,488,434 A * 1/1996 Jung ..... 348/725
5,648,795 A 7/1997 Vouri et al.
5,801,684 A * 9/1998 Uskali ..... 345/213
6,078,317 A * 6/2000 Sawada ..... 345/204
6,078,319 A * 6/2000 Bril et al. ..... 345/211
6,222,589 B1 4/2001 Faroudja et al.
6,327,708 B1 * 12/2001 Monsees ..... 725/12
6,392,642 B1 * 5/2002 Wu ..... 345/213
6,452,582 B1 * 9/2002 Rolston ..... 345/102

OTHER PUBLICATIONS

Hitachi, "Introduction to Monitor & Flat Panel Display Technology", Hitachi Displays, 2 pgs., <http://www.hitachidisplays.com>.

* cited by examiner

*Primary Examiner*—Xiao Wu
*Assistant Examiner*—Kevin M. Nguyen

(57) ABSTRACT

A system and method of automatically selecting a vertical refresh rate for a video display monitor is disclosed.

The system includes an ambient light frequency identifier and a vertical refresh rate selector. The ambient light frequency identifier is configured for capturing lightwaves from an ambient light source and for identifying a frequency of the lightwaves. The vertical refresh rate selector is configured for automatically selecting a vertical refresh rate for the video display monitor based on the identified ambient light frequency.

23 Claims, 7 Drawing Sheets

METHOD AND SYSTEM FOR AUTOMATICALLY SELECTING A VERTICAL REFRESH RATE FOR A VIDEO DISPLAY MONITOR

THE FIELD OF THE INVENTION

The present invention is generally related to video monitors and in particular, to a video display monitor with an automatically selected vertical refresh rate.

BACKGROUND OF THE INVENTION

For most people, the nature of labor has greatly changed. Not too long ago, many workers were exposed to hazardous materials and deplorable conditions. Many a heavy load was carried on the back of a laborer. Today's workforce would be barely recognizable by those manual laborers. We now sit at computers, click on our mice and type away at the keyboards. While seemingly non-injurious, long-term computer use has created a whole new class of workplace injuries. For example, many people that type at computer keyboards for long periods of time, such as secretaries and word processing specialists, suffer from repetitive stress injuries to their wrists and fingers. Many of those same workers also suffer from back and neck strain from looking at their computer monitors.

Eyestrain also is sometimes experienced after extended viewing of computer video display monitors. Several factors contribute to eyestrain including glare, insufficient screen resolution, and poor lighting. Other contributors to eyestrain include excessive screen brightness as well as flicker.

Flicker is commonly associated with the vertical refresh rate of the video display monitor. In particular, when the vertical refresh rate of the video display monitor is close to a frequency of oscillating light emanating from ambient sources, such as overhead fluorescent lights, the display on the video monitor tends to flicker. Flicker is annoying and can cause eyestrain.

While conventional video display monitors use software to select a vertical refresh rate, the selected vertical refresh rates typically fail to account for actual use conditions. For instance, some countries use different conventions for carrying electrical current. European countries use a 50 Hz cycle current while the United States uses 60 Hz as a working frequency. Moreover, some working environments may include other light frequency sources that impinge on a video display monitor. Video monitors that fail to account for these differences and factors are more likely to produce flicker.

Given these considerations, there is still much room for improving the quality of images displayed on a video display monitor.

SUMMARY OF THE INVENTION

A method of the present invention for automatically selecting a vertical refresh rate for a video display monitor comprises determining an ambient light frequency adjacent the video display monitor and selecting the vertical refresh rate of the video display monitor to be sufficiently different than the ambient light frequency to minimize flicker of the video display monitor.

A vertical refresh rate selection system for a video display monitor comprises an ambient light frequency identifier and a vertical refresh rate selector. The ambient light frequency identifier is configured for capturing lightwaves from an ambient light source and for identifying a frequency of the lightwaves. The vertical refresh rate selector is configured for selecting a vertical refresh rate for the video display monitor that minimizes flicker based on the identified ambient light frequency.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Components of the method and system of the present invention can be implemented in hardware via a microprocessor, programmable logic, or state machine, in firmware, or in software within a given device. Components of the present invention may also reside in software on one or more computer-readable mediums. The term computer-readable medium as used herein is defined to include any kind of memory, volatile or non-volatile (e.g., floppy disks, hard disks, CD-ROMs, flash memory, read-only memory (ROM), and random access memory (RAM)).

Preferably, the user interfaces described herein run on a controller, computer, appliance or other device having an operating system which can support one or more applications. The operating system is stored in memory and executes on a processor. The operating system is preferably a multi-tasking operating system which allows simultaneous execution of multiple applications, although aspects of this invention may be implemented using a single-tasking operating system. The operating system employs a graphical user interface windowing environment which presents the applications or documents in specially delineated areas of the display screen called "windows." Each window has its own adjustable boundaries which allow the user to enlarge or shrink the application or document relative to the display screen. Each window can act independently, including its own menu, toolbar, pointers, and other controls, as if it were a virtual display device. The operating system preferably includes a windows-based dynamic display which allows for the entry or selection of data in dynamic data field locations via an input device such as a keyboard and/or mouse. One preferred operating system is a Windows® brand operating system sold by Microsoft Corporation. However, other operating systems which provide windowing environments may be employed, such as those available from Apple Corporation or IBM. In another embodiment, the operating system does not employ a windowing environment.

Figure 1:
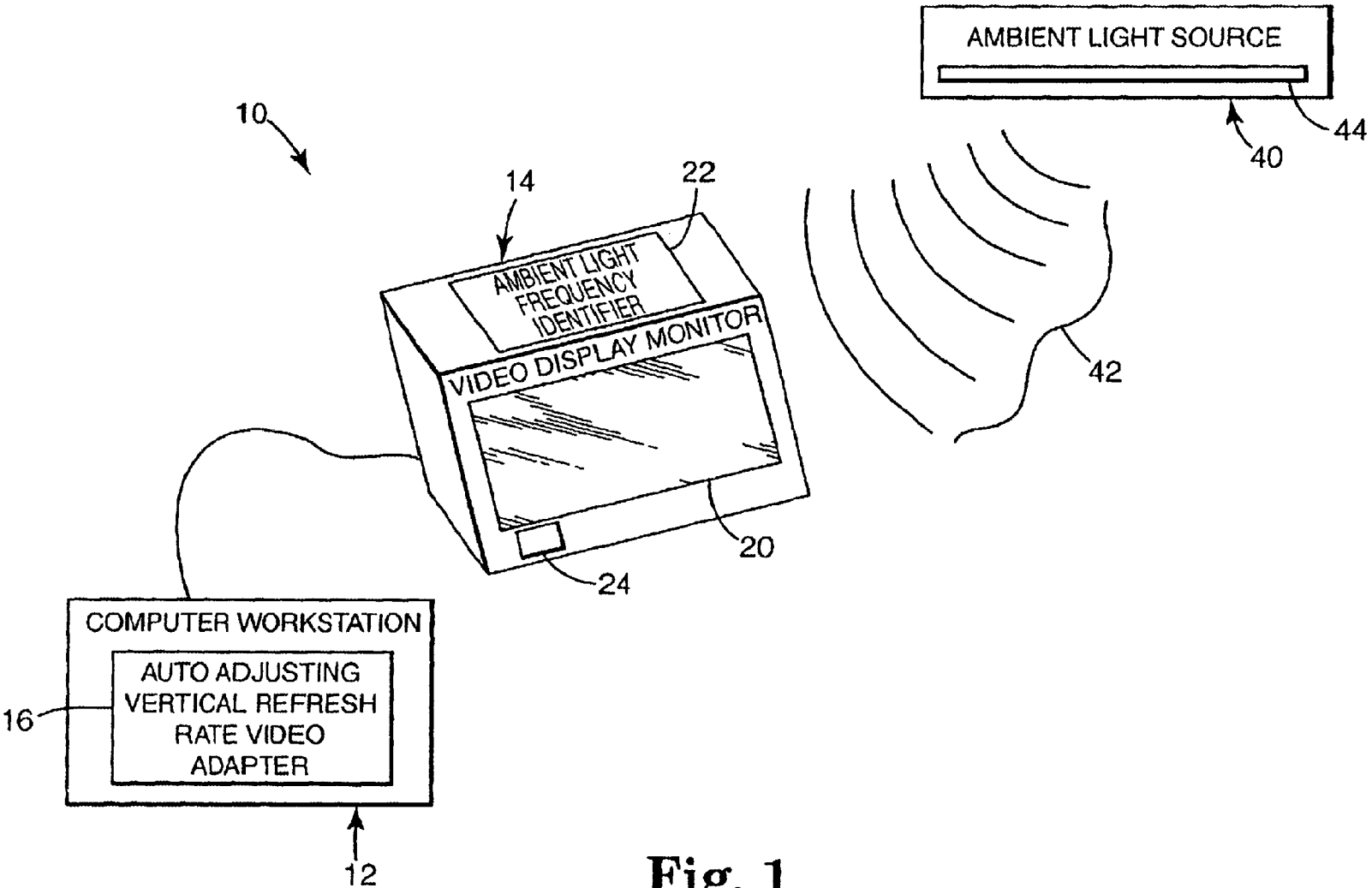
FIG. 1 is a diagram illustrating one exemplary embodiment of an automatic vertical refresh rate selection system of the present invention.

FIG. 1 illustrates an exemplary embodiment of system 10 according to the present invention. System 10 includes computer workstation 12 and video display monitor 14. Computer workstation 12 includes auto-adjusting vertical refresh rate video adapter 16 while video display monitor 14 includes display screen 20 and ambient light frequency identifier 22 with photo sensor 24.

System 10 is used within the proximity of ambient light source 40 which produces oscillating lightwaves 42 that impinge on display screen 20. Ambient light source 40 typically includes fluorescent light source 44, as commonly found in most offices and computer work environments. Oscillating light waves 42 occasionally produce flicker on display screen 20 when a frequency of the oscillating light waves 42 is substantially similar to a frequency of a vertical refresh rate of display screen 20. In prior art systems, flicker is commonly managed with software-controlled selection of different vertical refresh rates, either pre-selected by the software or manually selected by the user.

However, with system 10 of the present invention, flicker is minimized or avoided through actually measuring the ambient light frequency that causes flicker and automatically selecting a vertical refresh rate designed to avoid flicker based on the measured ambient light frequency.

In use, photosensor 24 captures ambient light waves 42 and ambient light frequency identifier 22 identifies the frequency of ambient light waves 42. Based on the measured frequency of ambient light waves 42, auto-adjusting vertical refresh rate video adapter 16 selects a vertical refresh rate designed to minimize flicker. This selected vertical refresh rate is then synchronized with a horizontal refresh rate signal and a red, green, blue (RGB) video signal before a composite video signal is sent from video adapter 16 to video display monitor 14. The system and method for automatically selecting a vertical refresh rate of the present invention will now be described in further detail.

Figure 2:
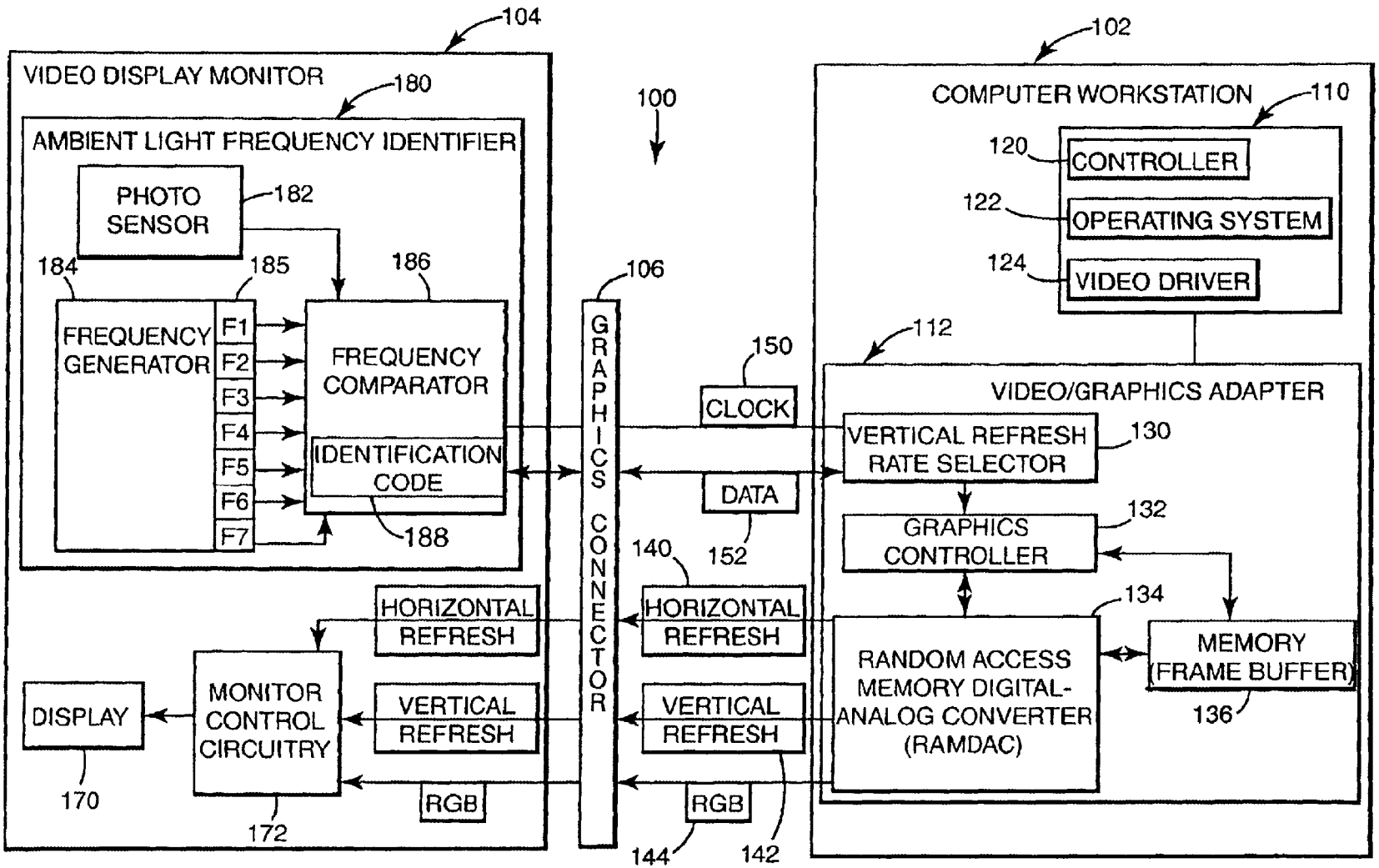
FIG. 2 is a block diagram illustrating one exemplary embodiment of the automatic vertical refresh rate selection system of the present invention.

As shown in FIG. 2, system 100 of the present invention includes computer workstation 102, video display monitor 104, and graphics connector 106. Computer workstation 102 comprises main components 110 and graphics adapter 112 with main components 110 including controller 120, operating system 122, and video driver 124. Graphics adapter 112 includes vertical refresh rate selector 130, graphics controller 132, random access memory digital analog converter (RAMDAC) 134, and memory (frame buffer) 136. In association with graphics adapter 112, system 100 includes horizontal refresh rate signal 140, vertical refresh rate signal 142, and red, green, blue (RGB) video signal 144. In addition, in association with graphics adapter 112, system 100 includes clock signal 150 and data signal 152.

Video display monitor 104 includes display 170 and monitor control circuitry 172. Video display monitor 104 further comprises ambient light frequency identifier 180 which includes photo sensor 182, frequency generator 184 with selector frequencies 185, and frequency comparator 186.

Computing workstation 102 preferably is a microprocessor based computing device and uses controller 120 that includes hardware, software, firmware or combination of these. In one preferred embodiment controller 120 includes a microprocessor-based system capable of performing a sequence and logic operation and including memory for storing information. Finally, computer workstation 102 can be any device that sends a video signal to video display monitor 104, wherein the signal includes a vertical refresh rate component and in which the device supports the video display monitor with a graphics adapter, memory, and a controller.

Operating system 122 preferably has the features of the previously described operating systems, such as a Windows®-based operating system. Video driver 124 is a software component dedicated to coordinating operation of video display monitor 104, in conjunction with graphics adapter 112, operating system 122, and controller 120.

Graphics adapter 112 includes conventional graphics adapter components including but not limited to, graphics controller 132, random access memory digital analog converter (RAMDAC) 134, and memory (frame buffer) 136. In addition, in one aspect of the present invention, graphics adapter 112 further includes vertical refresh rate selector 130. Vertical refresh rate selector 130 cooperates with ambient light frequency identifier 180 to select a vertical refresh rate signal 142 suitable for minimizing flicker on video display monitor 104. Vertical refresh rate selector 130 also communicates with graphics controller 132 and RAMDAC 134 for synchronizing selected vertical refresh rate signal 142 with horizontal refresh rate signal 140 and RGB video signal 144.

Display 170 and monitor control circuitry 172 of video display monitor 104 are well known components for respectively displaying a video signal and converting an analog video signal and displaying it as a graphic image.

In use, photosensor 182 of ambient light frequency identifier 180 of video display monitor 104 captures a sampling of light waves 42 from ambient light source 40 for identifying the frequency of ambient light source 40. Frequency generator 184 generates multiple frequencies which have values within a small range encompassing the expected ambient light frequency. For example, select frequencies 185 preferably include frequencies F1–F8 such as 50 Hz, 56 Hz, 60 Hz, 65 Hz, 70 Hz, 72 Hz, 75 Hz, and 85 Hz. Frequency comparator 186 receives the measured ambient light frequency from photosensor 182 and compares it with select frequencies 185 from frequency generator 184 to identify the value of the ambient light frequency. Once a matching frequency is found, then frequency comparator 186 produces an identification code 188 corresponding to the identified ambient light frequency and sends that identification code 188 as data signal 152 to vertical refresh rate selector 130 through graphics connector 106.

Vertical refresh rate selector 130 of graphics adapter 112 decodes identification code 188 to identify the ambient light frequency and then selects a value of a vertical refresh rate that is known not to cause flicker in association with the identified ambient light frequency. This value of the vertical refresh rate signal is sent to graphics controller 132 and RANDAC 134 so that a composite video signal can be generated with synchronization between the vertical refresh rate signal 142 (having the automatically selected vertical refresh rate), horizontal refresh rate signal 140, and RGB video signal 144. Accordingly, the composite synchronized video signal includes vertical refresh rate signal 142 that has been selected to avoid flicker while accounting for resolution, color, and other parameters, all in association with horizontal refresh rate signal 140 and RGB video signal 144.

Accordingly, ambient light frequency identifier 180 (including photosensor 182, frequency generator 184, and frequency comparator 186) and vertical refresh rate selector 130 act together to identify the frequency of an ambient light source and select a vertical refresh rate configured to minimize flicker. This system automatically selects an appropriate vertical refresh rate that avoids flicker based on an actually measured ambient light frequency rather than an assumed ambient light frequency. This feature allows the convenient adaptation of video display monitor 104 to many different situations beyond the conventional flicker-inducing environment.

In this embodiment, ambient light frequency identifier 180 is located on or in video display monitor 104 while vertical refresh rate selector 130 is located on graphics adapter 112 within computer workstation 102. Photo sensor 182 of ambient light frequency identifier 180, like photo sensor 24 shown in FIG. 1, is preferably located on a surface of video display monitor 104 that is exposed to ambient light source 40.

The components of ambient light frequency identifier 180 and vertical refresh rate selector 130 of system 100 of the present invention optionally can be located in varying arrangements between video display monitor 104, computer workstation 102 and/or externally located housings. For example, all of the components of ambient light frequency identifier 180 and vertical refresh rate selector 130 can be located within video display monitor 104, or all of the components can be located within computer workstation 102 on graphics adapter 112 (or other plug-in board that communicates with a graphics adapter). However, photo sensor 182 must be exposed to ambient light source 40. Finally, all of the components also optionally can located together in a free standing housing external of both video display monitor 104 and computer workstation 102. Each of these alternate arrangements will be described later in greater detail in association with FIGS. 5–8.

Figure 3:
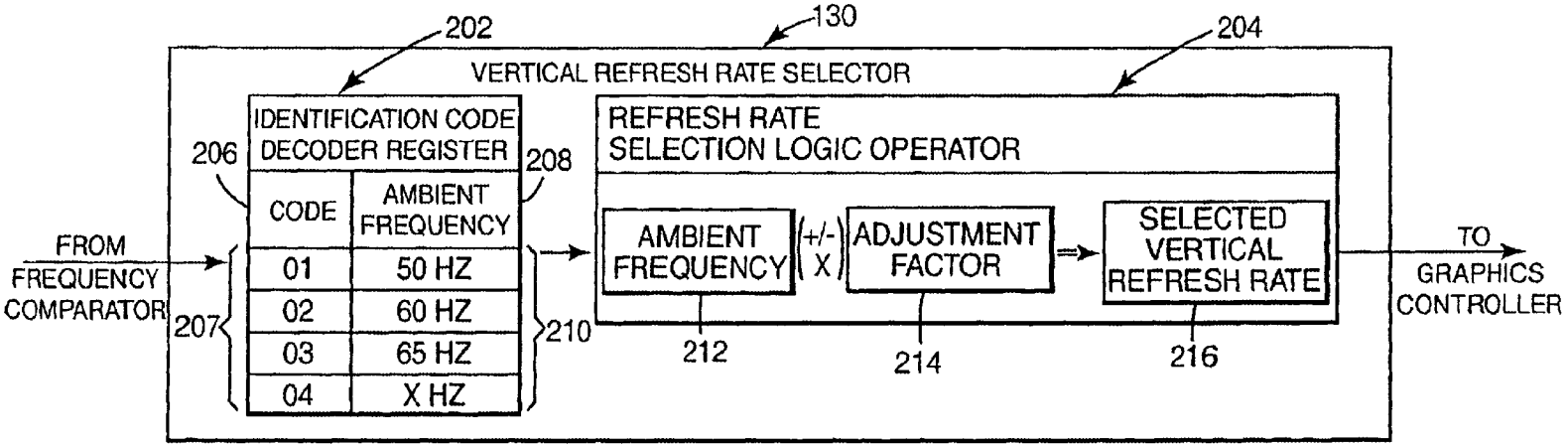
FIG. 3 is a block diagram illustrating one exemplary embodiment of a vertical refresh rate selector of the present invention.

As shown in FIG. 3, in one aspect of the present invention, vertical refresh rate selector 130 includes identification code decoder register 202 and refresh rate selection logic operator 204. Decoder register 202 includes identification code listing 206 with known codes 207 (e.g., 01, 02, etc) and ambient light frequency listing 208 with corresponding light frequencies 210 (e.g., 50 Hz, 60 Hz, etc). Decoder register 202 receives a signal from frequency comparator 186 with identification code 188 that corresponds to measured ambient light frequency. After decoding identification code 188, decoder register 202 sends a signal with the ambient light frequency value to refresh rate selection logic operator 204.

Logic operator 204 performs a logic operation on the ambient light frequency value 212 using adjustment factor 214 (with addition, subtraction, multiplication, and/or other operators) to produce vertical refresh rate 216 that is selected to minimize flicker. This vertical refresh rate 216 is sent to graphics controller 132. The logic operation can be carried out using many known logic circuit operators so that a refresh rate is selected that is sufficiently different than the ambient light frequency to minimize flicker. The selected vertical refresh rate preferably is at least about 10 Hz greater or 10 Hz less than the ambient light frequency. It is believed by those skilled in the art that most people do not detect flicker when the difference between the ambient light frequency and the vertical refresh rate is on the order of about 10 Hz. Finally, with all other factors being equal, faster vertical refresh rates are generally preferable over slower vertical refresh rates to maintain higher quality graphic images on video display monitor 104.

Figure 4:
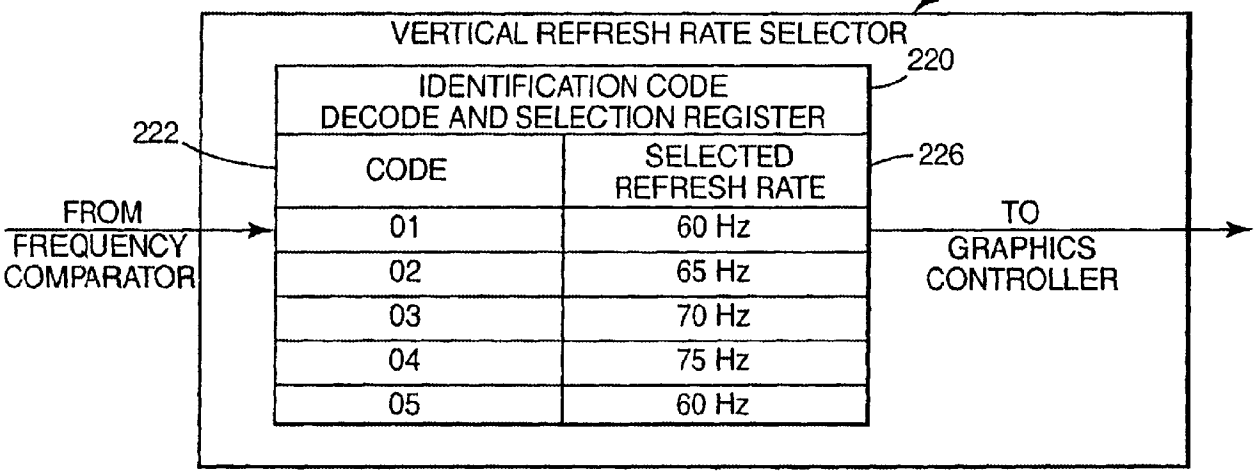
FIG. 4 is a block diagram illustrating one exemplary embodiment of an alternate vertical refresh rate selector of the present invention.

Alternatively, as shown in FIG. 4, in another aspect of the present invention, vertical refresh rate selector 131 is used in place of vertical refresh rate selector 130. Vertical refresh rate selector 131 comprises identification code decoder register 220 including code listing 222 and selected vertical refresh rate listing 226. With this arrangement, a selected vertical refresh rate from listing 226 already has been selected for each ambient light frequency that corresponds to one of the codes in listing 222 and built into decoder register 220.

Accordingly, vertical refresh rate selector 131 produces a signal that is sent to graphics controller 132 that identifies vertical refresh rate 226 selected to avoid flicker.

Figure 5:
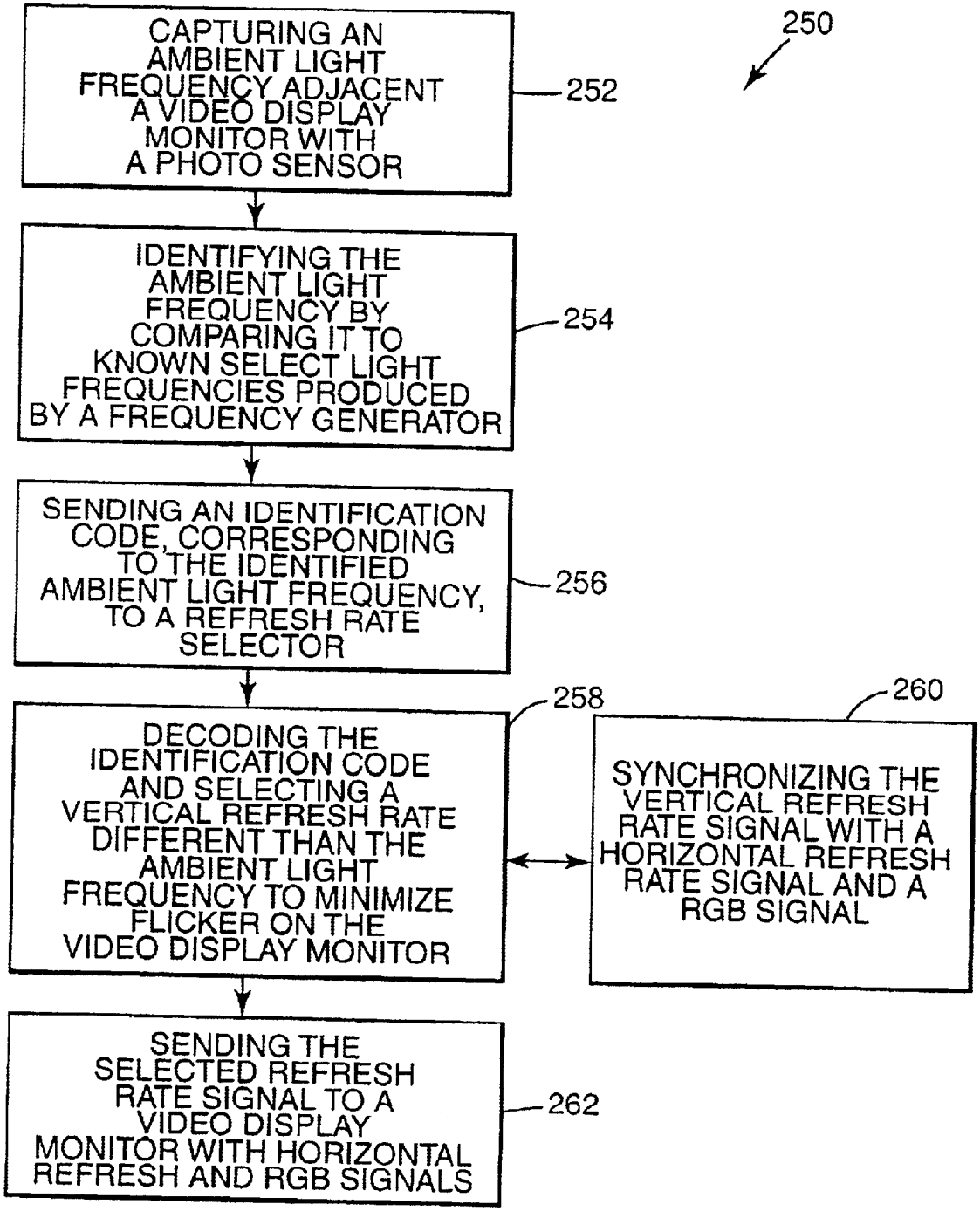
FIG. 5 is a flow diagram illustrating one exemplary embodiment of a method of automatically selecting a vertical refresh rate of the present invention.

FIG. 5 is a flow diagram illustrating method 250 of automatically selecting a vertical refresh rate, according to one embodiment of the present invention. Method 250 includes first step 252 of capturing ambient light 42 adjacent video display monitor 104 with photo sensor 24, 182. Next, method 250 includes identifying the frequency of ambient light 42 by comparing the ambient light frequency to select light frequencies 185 produced by frequency generator 184 (step 254). Then, identification code 188, corresponding to the identified ambient light frequency, is sent from frequency comparator 186 to refresh rate selector 130 (step 256). Using vertical refresh rate selector 130, method 250 further comprises decoding identification code 188 and selecting vertical refresh rate 216,226 that is sufficiently different than the ambient light frequency to minimize flicker on video display monitor 104 (step 258). Step 258 of method 250 further includes step 260 of synchronizing a vertical refresh rate signal 142 with horizontal refresh rate signal 140 and RGB signal 144. Finally, step 262 of method 250 includes sending the synchronized video signal to video display monitor 104 with the video signal including vertical refresh rate signal 142 having the automatically selected rate value.

Figure 6:
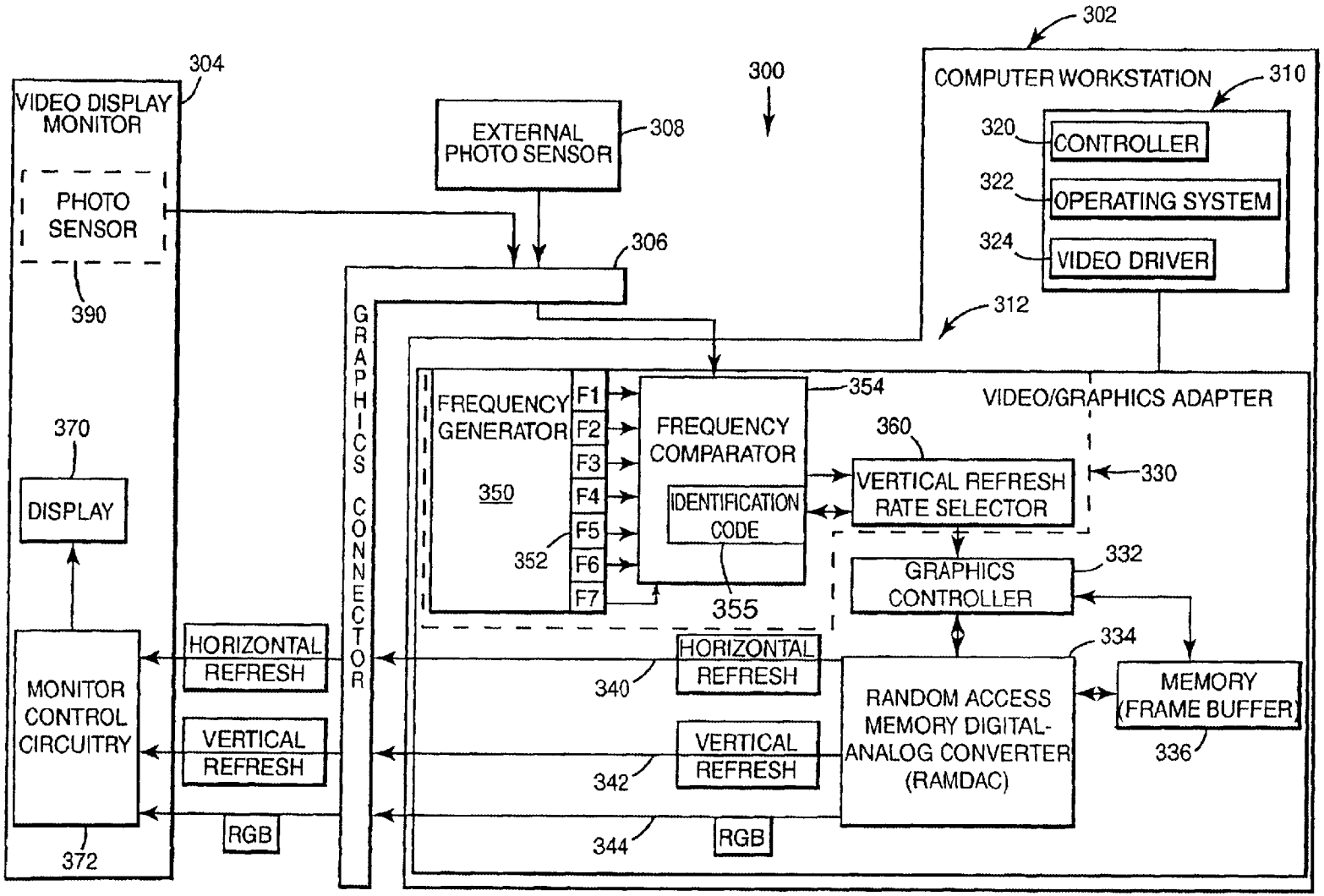
FIG. 6 is a block diagram illustrating one exemplary embodiment of an alternate automatic vertical refresh rate selection system of the present invention.

Another exemplary embodiment of the present invention includes system 300, which is illustrated in FIG. 6. System 300 incorporates all components of the ambient light frequency identifier and vertical refresh rate selector of the present invention on a graphics adapter 312 (or other plug-in board) within computer workstation 302. Only photosensor 308, which cooperates with the ambient light frequency identifier, is located externally of computer workstation 302.

As shown in FIG. 6, system 300 includes computer workstation 302, video display monitor 304, graphics connector 306, and external photo sensor 308. Computer workstation 302 comprises main components 310 and graphics adapter 312 with main components 310 including controller 320, operating system 322, video driver 324. Graphics adapter 312 includes ambient light frequency identifier circuitry 330, graphics controller 332,random access memory digital analog converter (RAMDAC) 334, and memory (frame buffer) 336. In association with graphics adapter 312, system 300 includes horizontal refresh rate signal 340,vertical refresh rate signal 342, and RGB video signal 344. Ambient light frequency identifier circuitry 330 includes frequency generator 350 with select frequencies 352, frequency comparator 354, and vertical refresh rate selector 360. Video display monitor 304 includes display 370 and monitor control circuitry 372. Video display monitor 304 also optionally further includes optional photo sensor 390 as an alternative to external photosensor 308.

Main components 310 of computer workstation 302 have substantially the same features and attributes of main components 110 of computer workstation 102. Similarly, display 370 and monitor control circuitry 372 of video display monitor 304 have substantially the same features and attributes of display 170 and monitor control circuitry 172 of video display monitor 104. Finally, frequency generator 350, frequency comparator 354, and vertical refresh rate selector 360 have substantially the same features as frequency generator 184, frequency comparator 186, and vertical refresh rate selector 130, except for the different location of those components.

In this embodiment, except for external photosensor 308, all of the components used for identifying an ambient light frequency (e.g., frequency generator 350 and frequency comparator 354) and for selecting the vertical refresh rate (vertical refresh rate selector 360) are located together on graphics adapter 312 in computer workstation 302. With this arrangement, the system and method of the present invention can be used with existing conventional monitors by simply replacing the conventional graphics adapter with graphics adapter 312 of the present invention and adding external photosensor 308. Alternatively, ambient light frequency identifier and refresh rate selector circuitry 330 can be implemented separately as a graphics co-adapter board insertable into an expansion slot within computer workstation 302 and communicate with the conventional graphics adapter through an auxiliary port of a conventional graphics adapter. Finally, when it is desirable to have no external components to system 300, optional photosensor 390 located on an exterior surface of video display monitor 304 is deployed in place of external photosensor 308.

To accommodate this arrangement, video driver 324 of main components 310 in computer workstation 302 include components for receiving the measured ambient light frequency from external photosensor 308 (or optional photosensor 390) into frequency comparator 354 and graphics adapter 312. The signal from photosensor 308 is preferably received through an auxiliary port of graphics adapter 312 or a modified portion of graphics connector 306. Finally, the signal carrying the selected vertical refresh rate from vertical refresh rate selector 360 is sent directly to graphics controller 332 (without any intermediate connectors) since all components are already contained on graphics adapter 312.

With the exception of the changed locations of the components of the ambient light frequency identifier and the vertical refresh rate selector, system 300 operates in substantially the same fashion as system 100 to produce a minimal-flicker synchronized video signal having an automatically selected vertical refresh rate that is based on actually measured ambient light conditions.

Figure 7:
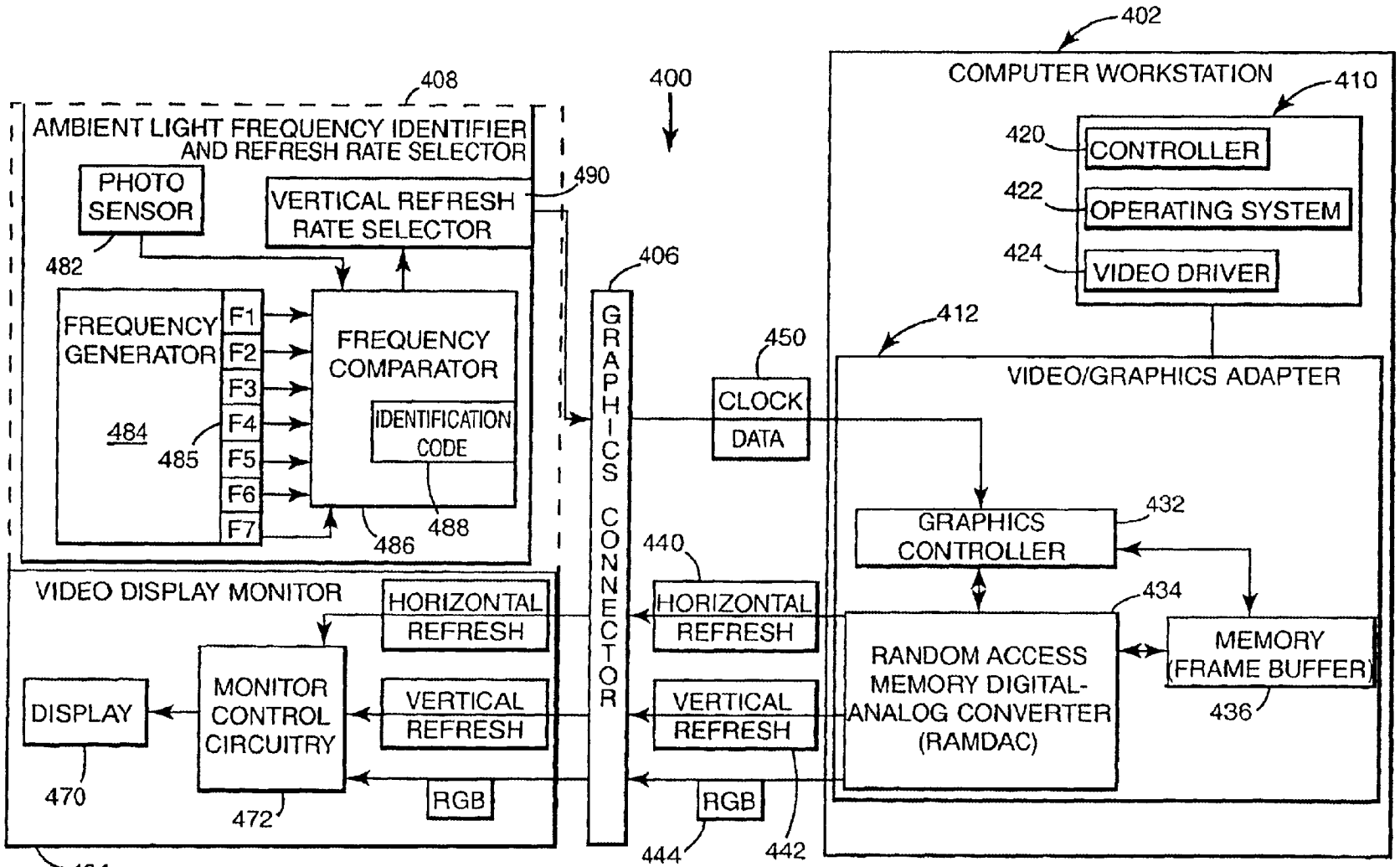
FIG. 7 is a block diagram illustrating one exemplary embodiment of an alternate automatic vertical refresh rate selection system of the present invention.

As show in FIG. 7, another exemplary embodiment of the present invention includes system 400. In system 400, all of the components of the ambient light frequency identifier and the vertical refresh rate selector, including the photosensor, are conveniently located within video display monitor 404. As shown in FIG. 7, system 400 includes computer workstation 402, video display monitor 404, graphics connector 406, and combined ambient light frequency identifier and refresh rate selector 408. Computer workstation 402 includes main components 410 including controller 420, operating system 422, and video driver 424. Graphics adapter 412 includes graphics controller 432, random access memory digital analog converter (RAMDAC) 434, and memory (frame buffer) 436. In association with graphics adapter 412, system 400 further includes horizontal refresh rate signal 440, vertical refresh rate signal 442, RGB video signal 444, and clock/data signal 450.

Video display monitor 404 includes display 470 and monitor control circuitry 472. Combined ambient light frequency identifier and refresh rate selector 408 includes photo sensor 482, frequency generator 484 with select frequencies 488, frequency comparator 486, and vertical refresh rate selector 490.

Main components 410 of computer workstation 402 have substantially the same features and attributes of main components 110 of computer workstation 102. Similarly, display 470 and monitor control circuitry 472 of video display monitor 404 have substantially the same features and attributes of display 170 and monitor control circuitry 172 of video display monitor 104. Finally, frequency generator 484, frequency comparator 486, and vertical refresh rate selector 490 have substantially the same features as frequency generator 184, frequency comparator 186, and vertical refresh rate selector 130, except for the modified location of those components.

In this embodiment, all of the components for identifying an ambient light frequency and selecting a vertical refresh rate are located together in video display monitor 404 and communicate with graphics controller 432 on graphics adapter 412. This arrangement conveniently allows video display monitor 404 to carry all components of system of the present invention so that graphics adapter 412 of computer workstation 402 need not be modified.

To accommodate this arrangement, selected vertical refresh rate 216 from vertical refresh rate selector 490 is fed into graphics controller 432 (and RAMDAC 434) as clock/data signal 450 to be synchronized with horizontal refresh rate signal 440 and RGB video signal 444, and any other desired signal parameters generated by graphics adapter 412. Video driver 424 of main components 410 in computer workstation 402 includes components for managing the reception of the vertical refresh rate selector signal into graphics controller 432 and for insuring proper synchronization between the automatically selected vertical refresh rate signal 442, horizontal refresh rate signal 440, and RGB video signal 444. The signal from vertical refresh rate selector 490 can be received through an auxiliary port of graphics adapter 412 or a modified portion of graphics connector 406.

As shown by the dotted lines in FIG. 7, combined ambient light frequency identifier and vertical refresh rate selector 408 optionally is arranged as a separate free standing device located externally of both video display monitor 404 and computer workstation 402. This arrangement allows the user to take an existing conventional video display monitor and conventional computer workstation and enjoy automatically selected vertical refresh rates by simply adding an external device containing combined ambient light frequency identifier and vertical refresh rate selector 408, along with an appropriate video driver 424 (as described above) to accommodate the change in hardware.

Figure 8:
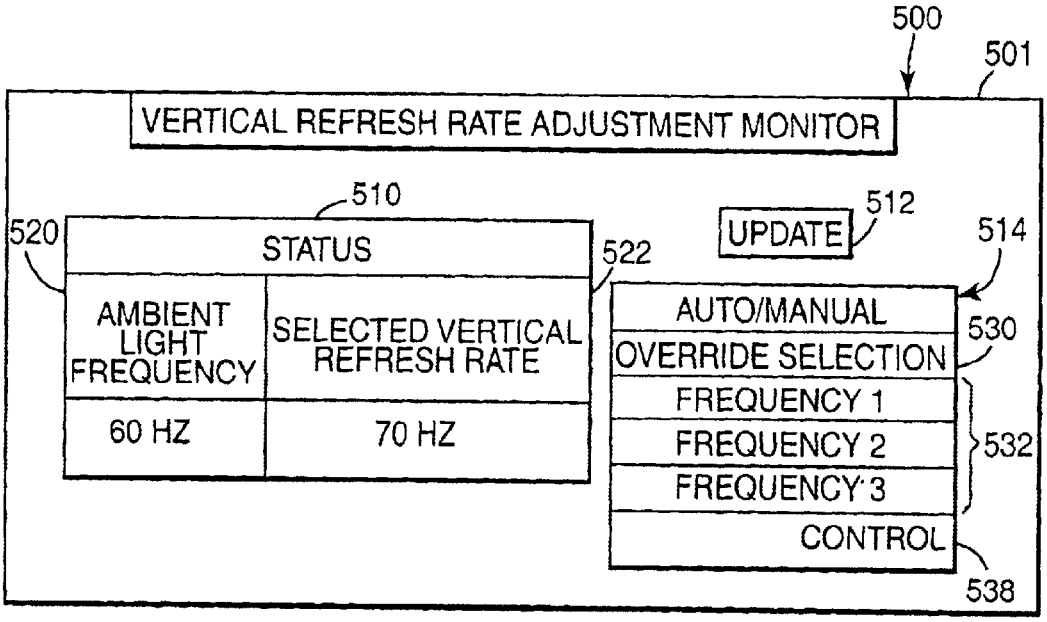
FIG. 8 is a block diagram illustrating one exemplary embodiment of a vertical refresh rate selection monitor of the present invention.

In another aspect of the present invention, user interface 500 includes vertical refresh rate monitor 501, which is provided for checking the status of the vertical refresh rate and for modifying the vertical refresh rate as necessary. As shown in FIG. 8, vertical refresh rate monitor 501 includes status function 510, update function 512, and auto/manual function 514. Status function 510 includes ambient light frequency listing 520 and selected vertical refresh rate listing 522. Auto/manual function 514 further includes override function 530, selectable frequencies 532, and operating system control function 538. Monitor 501 is governed by a video driver, such as video drivers 124, 324, 424.

Status monitor 501 displays the last measured ambient light frequency 520 and corresponding automatically selected vertical refresh rate 522. Update function 512 is used when a vertical refresh rate has already been selected and implemented. Update function 512 activates system 100 to repeat method 250 so that the ambient light frequency is re-identified and the vertical refresh rate is re-selected. This update procedure may or may not result in the selected and implemented vertical refresh rate being different than the original automatically selected vertical refresh rate.

Auto/manual function 514 provides control over whether the vertical refresh rate is selected automatically or manually. Manual selection can be implemented through override function 530 in which one of several frequencies is selected as the vertical refresh rate. Finally, operating system control 538 permits the selection of a vertical refresh rate to be governed exclusively through the operating system of computer workstation 102, 302, 402, in association with video display monitor 104, 304,404. These latter control options are available in the event that is desired not to employ automatic selection of a vertical refresh rate.

A system and method of the present invention for automatically selecting a vertical refresh rate for a video display monitor carries many advantageous features including selecting a vertical refresh rate based on an actually measured ambient light frequency rather than an assumed ambient light frequency. With this feature, a video display monitor can automatically avoid flicker in almost any environment, since the vertical refresh rate selection is based on present use conditions and is automatically adjustable as the ambient environment changes. The components that identify the ambient light frequency and select the refresh rate can be conveniently located in various arrangements between the video display monitor, computer workstation, and/or externally of both. Accordingly, a system and method of the present invention can be implemented in a monitor alone, in a graphics adapter alone, as a freestanding housing device, or in a combination of all three arrangements.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An automatic vertical refresh rate selection system for a video display monitor comprising:

an ambient light frequency identifier configured for capturing lightwaves from an ambient light source and for identifying a frequency of the lightwaves; and a vertical refresh rate selector configured for selecting a vertical refresh rate for the video display monitor based on the identified ambient light frequency with the selected vertical refresh rate being substantially different than the identified ambient light frequency.

2. The system of claim 1 wherein the ambient light frequency identifier comprises:

a photo sensor configured for capturing the ambient lightwaves;

a frequency generator configured for generating a plurality of select light frequencies for comparison with the ambient light waves; and a frequency comparator configured for comparing a frequency of the captured ambient lightwaves with the select frequencies from the frequency generator to determine the ambient light frequency and configured for producing an identification code signal corresponding the determined ambient light frequency.

3. The system of claim 2 wherein the select frequencies comprise the frequencies of:

56 Hz, 60 Hz, 65 Hz, 70 Hz, 72 Hz, 75 Hz, and 85 Hz.

4. The system of claim 2 wherein the vertical refresh rate selector comprises:

a decoder module configured for determining the ambient light frequency value based on the identification code and configured for selecting the vertical refresh rate to be sufficiently different than the ambient light frequency by at least 10 Hertz to minimize flicker of the video display monitor.

5. The system of claim 4 wherein the vertical refresh rate selector further comprises at least one of:

a refresh rate register configured with selectable vertical refresh rates with each selectable vertical refresh rate corresponding to a different ambient light frequency wherein the correspondence reflects each refresh rate being suitable for minimizing flicker for the corresponding ambient light frequency; and a refresh rate logic operator configured for performing a logic operation on the value of the ambient light frequency to determine the vertical refresh rate.

6. A computing system with an automatic vertical refresh rate selection system for a video display of the computing system, the system comprising:

a video display monitor;

a photosensor located externally of the video display monitor and configured for capturing ambient lightwaves adjacent the video display monitor; and a computing workstation comprising a graphics adapter including:

an ambient light frequency identifier configured for receiving a signal from the photosensor corresponding to the captured lightwaves and configured for identifying a frequency of the ambient lightwaves;

a vertical refresh rate selector configured for selecting a vertical refresh rate for the video display monitor based on the identified ambient light frequency, with the selected vertical refresh rate being at least one of about 10 Hertz greater than the identified ambient light frequency and about 10 Hertz less than the identified ambient light frequency, and configured for producing a signal indicating the selected vertical refresh rate; and a graphics controller configured for receiving the signal from the vertical refresh rate selector that identifies the selected vertical refresh rate and configured for sending a synchronized video signal to the video display monitor that includes a vertical refresh rate signal having the selected vertical refresh rate.

7. The system of claim 6 wherein the photosensor is mounted externally from the video display monitor.

8. The system of claim 6 wherein the photosensor is mounted on the video display monitor.

9. A video display monitor having an automatically selectable vertical refresh rate, the monitor comprising:

a display screen;

an ambient light frequency identifier configured for measuring lightwaves from an ambient light source adjacent the video display monitor and for identifying a frequency of the lightwaves;

a vertical refresh rate selector configured for selecting a vertical refresh rate for the video display monitor based on the identified ambient light frequency, with the selected vertical refresh rate being substantially different than the identified ambient light frequency and for producing a signal that identifies the selected vertical refresh rate; and monitor control circuitry configured to receive a synchronized video signal including a vertical refresh rate signal having the selected vertical refresh rate and configured to send the synchronized video signal to the display screen.

10. The monitor of claim 9 wherein the ambient light frequency identifier includes a photosensor mounted on the video display monitor and configured for capturing the lightwaves from the ambient light source.

11. An automatic vertical refresh rate selection system for a video display monitor comprising:

a photosensor configured for capturing light waves from an ambient light source and configured for disposition near the light waves; and a graphics adapter configured for connection to a computing device including:

an ambient light frequency identifier in coupled communication with the photosensor and configured for identifying a frequency of the captured ambient light waves; and a vertical refresh rate selector configured for selecting a vertical refresh rate for a video display monitor based on the identified ambient light frequency, with the selected vertical refresh rate being at least one of about 10 Hertz greater than the identified ambient light frequency and about 10 Hertz less than the identified ambient light frequency, and producing a signal configured for sending a value of the vertical refresh rate to a graphics controller.

12. The system of claim 11 and further comprising:

a housing configured for containing the ambient light frequency identifier and the vertical refresh rate selector and configured for securing the photosensor on an exterior surface of the housing.

13. A graphics adapter having an automatic vertical refresh rate selection system for a video display monitor, the graphics adapter comprising:

an ambient light frequency identifier configured for receiving a signal of captured ambient light waves and configured for identifying a frequency of the captured ambient light waves;

a vertical refresh rate selector in communication with the ambient light frequency identifier and configured for selecting a vertical refresh rate for a video display monitor based on the identified ambient light frequency with the selected vertical refresh rate being substantially different than the identified ambient light frequency; and a graphics controller configured for implementing the selected vertical refresh rate in a synchronized video signal for transmission to a video display monitor with the synchronized video signal including a horizontal refresh rate signal, a red, green, blue video signal, and a vertical refresh rate signal having the selected vertical refresh rate.

14. A vertical refresh rate selection graphics co-adapter for a video display monitor, the co-adapter comprising:

an ambient light frequency identifier configured for receiving a signal of captured ambient light waves and configured for identifying a frequency of the captured ambient lightwaves;

a vertical refresh rate selector configured for selecting a vertical refresh rate for a video display monitor based on the identified ambient light frequency with the selected vertical refresh rate being substantially different than the identified ambient light frequency and configured for producing a signal identifying the selected vertical refresh rate; and a connector configured for coupled communication with a graphics controller of a graphics adapter and configured to transmit the signal identifying the selected vertical refresh rate to the graphics controller of the graphics adapter.

15. The graphics co-adapter of claim 14 and further comprising:

an expansion circuit board configured for carrying the ambient light frequency identifier, the vertical refresh rate selector, and the connector, and configured for removable insertion into an expansion slot of a computing workstation.

16. A method for minimizing flicker of a video display monitor comprising:

determining an ambient light frequency adjacent the video display monitor; and selecting a vertical refresh rate of the video display monitor, based on the determined ambient light frequency, to be substantially different than the determined ambient light frequency to minimize flicker of the video display monitor.

17. The method of claim 16 wherein determining the ambient light frequency comprises:

capturing the ambient light frequency with a photo sensor; and identifying the ambient light frequency by comparing the ambient light frequency with a plurality of select frequencies to match the ambient light frequency with one of the select frequencies.

18. The method of claim 17 wherein identifying the ambient light frequency further comprises:

selecting an identification code corresponding with the identified ambient light frequency and submitting that identification code to a vertical refresh rate selector.

19. The method of claim 17 wherein selecting the identification code further comprises:

submitting an identification of the ambient light frequency to a refresh rate monitor for selecting the refresh rate to be substantially different than the ambient light frequency by about 10 Hertz with the selected refresh rate being at least one of about 10 Hertz greater than the identified ambient light frequency and about 10 Hertz less than the identified ambient light frequency.

20. The method of claim 16 and further comprising:

synchronizing a vertical refresh rate signal having the automatically selected vertical refresh rate with a horizontal refresh rate signal and a red, green, blue video signal.

21. An automatic vertical refresh rate selection system for a cathode ray tube video display monitor comprising:

an ambient light frequency identifier configured for capturing lightwaves from an ambient light source and for identifying a frequency of the lightwaves; and a vertical refresh rate selector configured for selecting a vertical refresh rate for the cathode ray tube video signal monitor based on the identified ambient light frequency wherein the selected vertical refresh rate is substantially different than the identified ambient light frequency.

22. The system of claim 21 wherein the selected vertical refresh rate is substantially different than the identified ambient light frequency by about 10 Hertz with the selected refresh rate being at least one of about 10 Hertz greater than the identified ambient light frequency and about 10 Hertz less than the identified ambient light frequency.

23. A computing system with an automatic vertical refresh rate selection system for an analog video display of the computing system, the system comprising:

an analog video display monitor;

a photo sensor located externally of the analog video display monitor and configured for capturing ambient lightwaves adjacent the analog video display monitor; and a computer workstation comprising a graphics adapter including;

an ambient light frequency identifier configured for receiving a signal from the photosensor corresponding to the captured lightwaves and configured for identifying a frequency of the ambient lightwaves;

a vertical refresh rate selector configured for selecting a vertical refresh rate for the analog video display monitor based on the identified ambient light frequency wherein the selected vertical refresh rate is substantially different than the identified ambient light frequency, and configured for producing a signal indicating the selected vertical refresh rate; and a graphics controller configured for receiving the signal from the vertical refresh rate selector that identifies the selected vertical refresh rate and configured for sending a synchronized analog video signal to the analog video display monitor that includes a vertical refresh rate signal having the selected vertical refresh rate.

* * * * *

UNITED STATES PATENT AND TRADEMARK OFFICE

CERTIFICATE OF CORRECTION

PATENT NO. : 6,862,022 B2
APPLICATION NO. : 09/910645
DATED : March 1, 2005
INVENTOR(S) : James P. Slupe It is certified that error appears in the above-identified patent and that said Letters Patent is hereby corrected as shown below:

IN THE CLAIMS

Claim 23, Column 14, line 2, delete “photo sensor” and insert therefor --photosensor--

Claim 23, Column 14, line 6, delete “computer” and insert therefor --computing--

Signed and Sealed this

Eighth Day of April, 2008

JON W. DUDAS
*Director of the United States Patent and Trademark Office*